US006312349B1

(12) United States Patent
Roberts

(10) Patent No.: US 6,312,349 B1
(45) Date of Patent: Nov. 6, 2001

(54) SPORTS TRAINING DEVICE

(76) Inventor: T. Sanford Roberts, P.O. Box 816, 311 N. Patterson Ave., Douglas, GA (US) 31533

( * ) Notice: Subject to any disclaimer, the term of this patent is extended or adjusted under 35 U.S.C. 154(b) by 0 days.

(21) Appl. No.: 09/430,756

(22) Filed: Oct. 29, 1999

(51) Int. Cl.[7] ..... A63B 69/00
(52) U.S. Cl. ..... 473/448; 473/446; 473/422
(58) Field of Search ..... 473/433, 415–420, 473/447–448, 446, 479, 485, FOR 101; 273/317.3, 401–402, 398–400

(56) References Cited

U.S. PATENT DOCUMENTS 3,160,414 * 12/1964 Gray ..... 473/448
3,342,486 * 9/1967 Farley ..... 473/448
4,762,319 * 8/1988 Krumholz ..... 473/416
4,786,053 * 11/1988 Barnes, Jr. ..... 473/416
5,308,059 * 5/1994 Owen, Jr. et al. ..... 473/448
5,813,926 * 9/1998 Vance ..... 473/448
5,827,136 * 10/1998 Halter et al. ..... 473/448
5,833,556 * 11/1998 Ferrari ..... 473/448

* cited by examiner

*Primary Examiner*—Jeanette Chapman
*Assistant Examiner*—Mitra Aryanpour
(74) *Attorney, Agent, or Firm*—John B. Dickman, III

(57) ABSTRACT

A training aid and method for basketball and other sports having a large hoop or "halo" supported on a vertical post for adjustment. The vertical post is mounted on a T-shaped base which supports the large hoop in such a way that a player can take shots through the hoop without contacting the base.

Training a player to properly shoot a basketball begins with teaching the proper method of holding the ball over the player's head and using the legs for a small, quick jump. Using the shot training aid, the player jumps and takes a shot with a high arc at the goal.

With other sports, the angle and height of the device can be adjusted as desired, but the dominant feature in the invention is that proficiency in all sports requiring projectiles to be accurately impelled toward a target can be improved.

1 Claim, 4 Drawing Sheets

SPORTS TRAINING DEVICE

BACKGROUND OF THE INVENTION

The present device is a trajectory training device and it works for basketball, baseball, softball, football, shot put, javelin throwing, and any other activity in which you propel an object manually. There is an optimum flight path that will result in the best outcome. The HSM lets you practice within the flight path. When you practice correctly, your performance will be better.

Before the present invention, identified as the "Halo Shot Master" or "HSM", a coach could explain how to project an object (shoot, throw, etc.) but the concept is very difficult to convey. The HSM is a mid-point training device that works by having you project the object through the circular hoop or "halo" portion of the device toward the ultimate goal. Having a predetermined path that is correct, lets you accelerate the learning and improvement. This is done without the user having to think about or be concerned about the theory. They just use it and it works. As understanding is achieved and fundamentals are improved the learning curve is greatly increased. You do not learn incorrectly, so you do not have to overcome bad habits. Existing bad habits-can be identified and corrected. The benefit of the HSM increases as your skill level improves.

"The Halo Shot Master, or "HSM," aids in developing proper form for shooting a basketball. The suspended halo aids the shooter in releasing the basketball at the proper point and with the proper arch. The halo is fully adjustable via telescoping pole. The HSM also helps the shooter square up with the goal which is a basic fundamental of shooting. It allows someone that has a basic understanding of the shooting to take that concept and make it a physical dynamic. You do not have to understand shooting, you just have to shoot through the halo. As a teaching aid you can show how it is done by letting the individual shoot through the halo not by just explaining a concept.

The adjustable height makes it suitable for any age or size. It also allows for freethrows, jumpshots or setshots. The open design allows the shooter to receive passes and shoot or to dribble under the halo and then shoot. The shooter can also follow his shot. The halo also gives the impression of being guarded and makes your practice more in keeping with the game conditions.

It can be used by an individual or a team. Works inside or outside. It is weatherproof, lightweight and virtually indestructible. The setup takes minutes and it stores in a corner.

One of the hardest things to overcome is a bad habit, this is particularly true of basketball players and their shooting habits. One bad habit young players have is a low trajectory in shooting. This leads to blocked shots, rim shots and shots which have limited chances of being made. Frequently the cause for low trajectory is a failure to fully extend one's arm at the point of release.

Basketball brings together talented players of different heights. Obviously, taller players have an advantage over shorter players, nevertheless, highly skilled shorter players overcome the odds and successfully compete. The primary reason they succeed, is they understand their shooting zone. They have a high arc and a quick release. The design patent to KRINGELIE, D 265,493, suggests a body mounted aid which appears to train a player to make high arcing shots; however, there is no disclosure and one can make several guesses about how to use the aid.

The problem with the KRINGELIE basketball aid, assuming it is to aid in shooting, is that the aid is worn by the players. Since the player is wearing the aid, it interferes with his natural movement, like moving without the ball and moving with the ball. A player cannot judge how close to a taller player he can come before shooting because there is nothing to establish a shooting zone.

The halo has many other applications.

Softball: In softball, the "halo" should be placed between the mound and the plate. The "halo" is tilted at a 45 degree angle and the stand is raised. By adjusting the height, distance and angle of the "halo" you can get the pitcher to use the legs, extend the arm and use the proper release point. This will help achieve the proper arch for the most effective pitch.

The "halo" has applications in football, baseball, shotput, and javelin throw. Anytime a projectile is involved, the "halo" can be used to show the intermediate flight path.

The "halo" can be used as a grade school playground activity to toss a ball, Frisbee or other appropriate projectile between players. It is great to entertain kids and can be used to focus playtime.

Baseball: You can control the flight path of the ball from the thrower to the target. It works infield to first base, outfielder to infielder, catcher to second base. Set "halo" at desired height for a flight path and have a player throw through the "halo."

It is the primary object of this invention to provide a basketball aid and method to instruct a player how to have a higher arc in his shots.

Another object of the invention is to provide a shot making training aid for many sports which is portable and inexpensive.

A further object is to provide a shot making training aid that is adjustable to the heights of different players.

SUMMARY OF THE INVENTION

The present invention relates to a basketball and other sports aid for improving a player's shooting and throwing.

The apparatus is a free standing pole that is portable from place to place and collapsible for storage. There is a supporting base engineered to safely keep the structure out of the way. The base and pole may be made of plastic tubing for a lightweight structure. However, for a more durable base and pole, metal tubing can be used. Mounted on the upper part of the pole is a large loop comprised of several large segments and at least twice the diameter of a basketball hoop.

The instructions for using the device in basketball training teach a player to move under the large hoop raising the ball high over his head for release. This forces the player to shoot with a high arc, thereby avoiding blocking shots.

DESCRIPTION OF THE INVENTION

Figure 1:
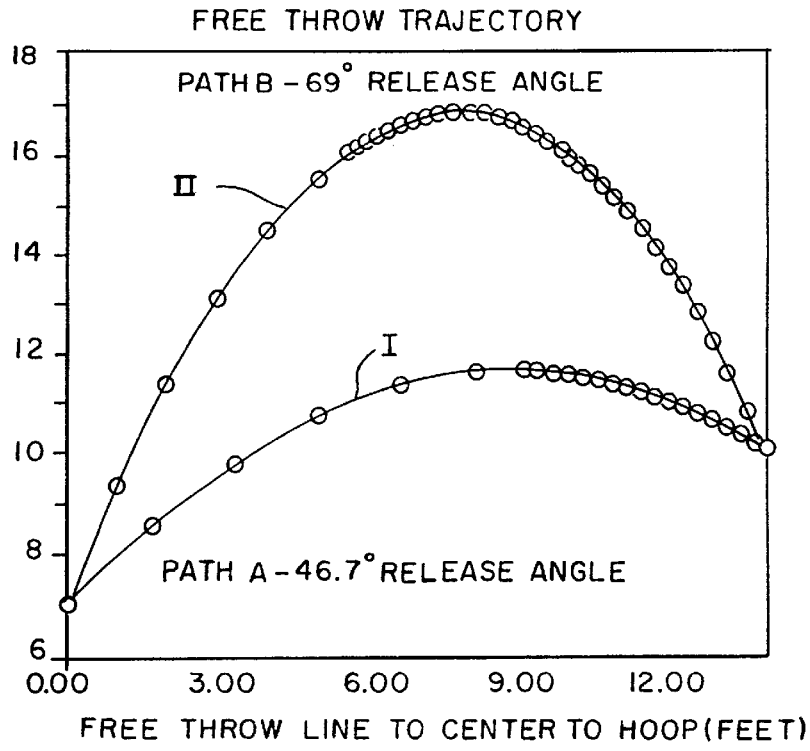
FIG. 1 is a graph showing the angle of trajectory of a free throw without the invention and the angle of trajectory of a free throw with the invention.

Referring to the drawings, FIGS. 1–5, there is shown a basketball and other sports shooting aid 10 for improving a player's shooting skills. The apparatus which makes up the shooting aid 10 is a knock-down, lightweight structure that may be a high impact plastic such as polypropelene, impact polystyrene, ABS resin, polycarbonate, nylon and the like. For some permanent structures, various metals may be used for part or all of the shooting aid 10.

Figure 3:
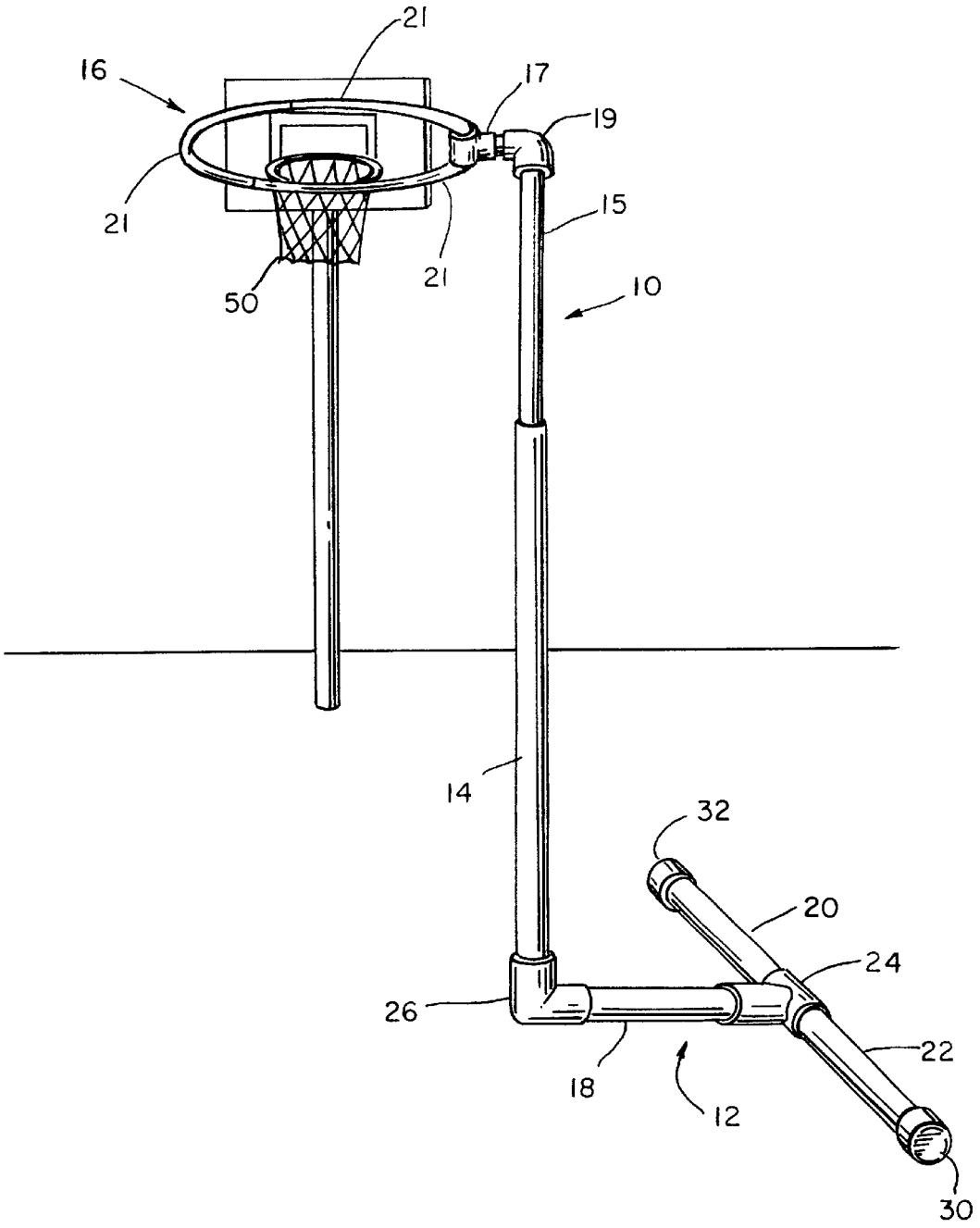
FIG. 3 shows a perspective view of a basketball aid of the invention.
Figure 4:
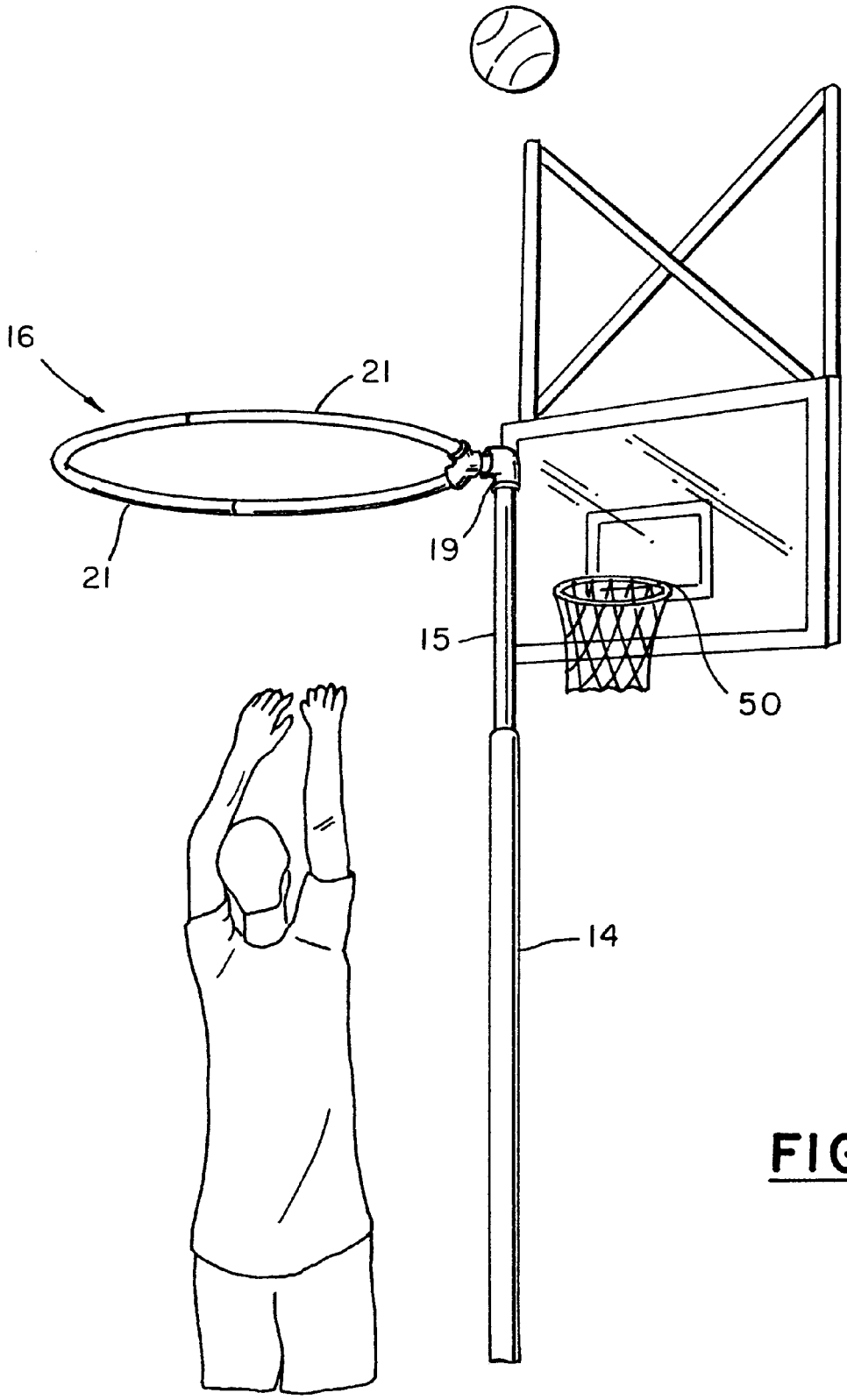
FIG. 4 shows a perspective view of a portion of the basketball aid and how the hoop is mounted on a vertical upper pole, which telescopes into a larger lower post.

FIG. 3 shows a shooting aid 10 having a base 12, a vertical lower upright pole 14, which receives a telescoping upper pole 15 and an adjustable hoop 16. Base 12 has a T-shaped structure where members 18, 20 and 22 are connected together by a T joint 24. Member 18 has a 90 degree elbow 26 at its free end, with elbow 26 positioned to receive a vertical upright pole 14. The free ends of members 20 and 22 have caps 30 and 32 which contact the ground to stabilize the base 12. Vertical upright pole 14 should be as tall as a defensive player, about 78 to 84 inches or perhaps as much as 120 inches.

Adjustable hoop 16 has a diameter of at least 3 feet and is connected to the upper pole 15 by a "T" fitting 17 which engages the free ends of the hoop to form a circle, and engages an L-shaped elbow 19 mounted on the upper end of the vertical upright pole 15. The hoop 16 comprises a series of plastic tubes 21 which are removably attached together and form the hoop. This hoop is flexible, and is an important feature which will be understood from the description of how the shooting aid works. The shooting aid is an apparatus that can be easily assembled and disassembled without tools, the parts being frictionally, threadedly or otherwise engaged.

Figure 2:
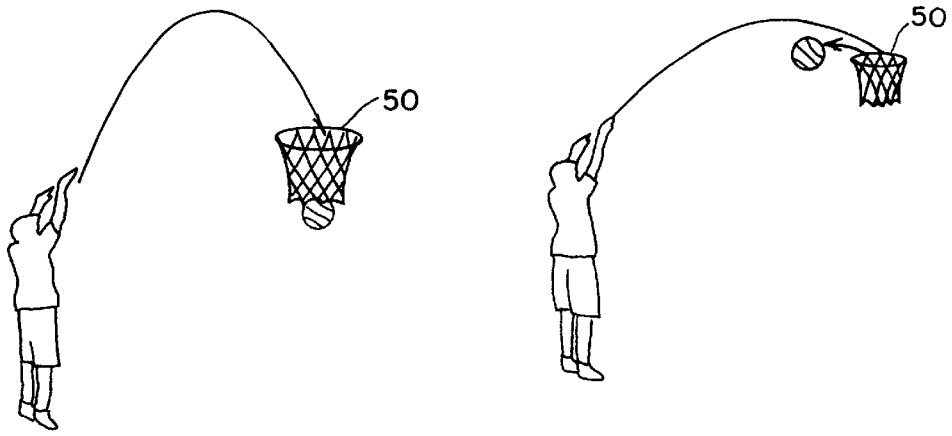
FIG. 2 shows the same trajectories as in FIG. 1 and the resulting shots.

In use, the shooting aid 10 is used to teach an improved method for shooting higher arc shots. It has been observed that the arc of a shot plays greatly in the chances of making it. As shown in the graph of FIG. 1, shooting free throws with a low arc I and with a higher arc II. The importance of the proper arc is that a low arc can only have a small margin of error, the ball either goes through the hoop or it bounces away; whereas, with a high arc, the shot is softer and lands softly on the hoop or backboard, if it does not drop directly through the hoop. Softer shots increase the apparent size of the hoop, that is, it allows the ball to bounce softly on the hoop and/or backboard before dropping through the hoop. FIG. 2 shows the results of the arc or trajectory of FIG. 1. The purpose of the shooting aid 10 is to improve shot awareness and confidence by increasing the goal area from 53 percent to 90 percent using a better angle of release.

Teaching a player to make better shots begins with the shooter's legs. The legs generate the energy for the shot. Using more leg movement is the answer for almost any problem with a shot. There should be a small, quick explosion-in the feet and ankles much like jumping rope. This will keep a player's shot quick and crisp with a snap to the follow-through.

The next point to teach a player is to keep the ball high and face the goal. By keeping the ball high and facing the goal, a player is able to see his teammates and take advantage of defensive mistakes. For example, a player can move a defender by faking a pass or a shot. Using a high release point, a player's shot will be quicker and he will be "taller"; thus allowing him to take a shot under pressure.

Figure 5:
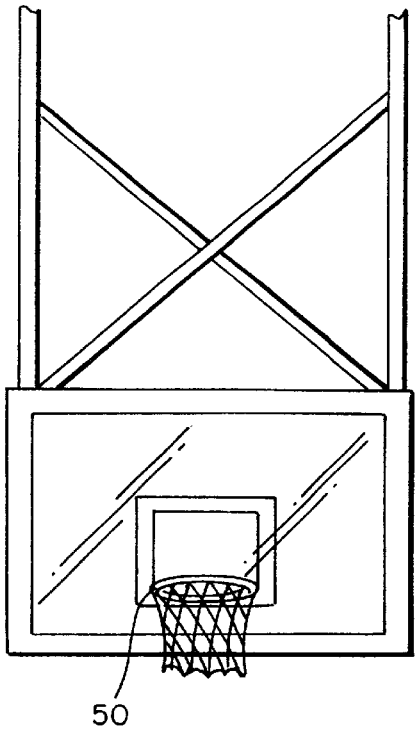
FIG. 5 shows a player taking a shot from the side using the invention.
Figure 5:
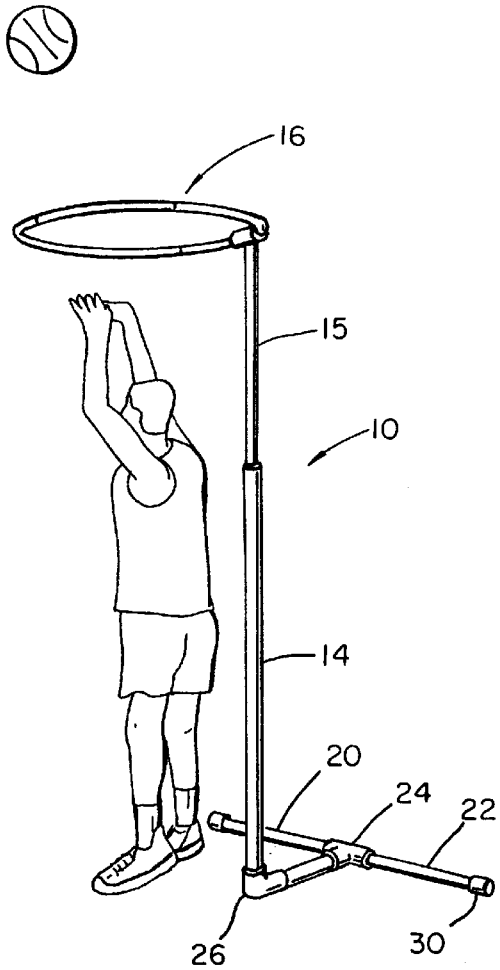

Once a player has learned to use his legs and to keep the ball high when facing the goal, he is ready to take full advantage of the shooting aid 10. Starting with standing under adjustable hoop 16 and facing the goal 50 in FIG. 5, the player P is passed the ball and he immediately raises it over his head and using a small quick explosion in the feet, he jumps and shoots. Because he has to shoot through the adjustable hoop 16, his shot is arced toward the goal 50, as illustrated in FIG. 5, At first the action may be awkward but with practice, the release will become natural and with the improved arc, more shots will drop.

Having mastered receiving the ball under the adjustable hoop 16, the player is then taught to dribble the ball under the hoop 16 and jump and shoot, using the already learned skills of using his legs and a high release.

Next the player learns how much arc to use from different "spots" or locations on the floor. The closer he is to the goal, the higher the adjustable hoop 16 is to simulate the constraint of a defender when shooting. The shooting aid 10 can help a player to determine how much room he needs to take a shot, pass or move the defender with a fake.

Learning the fundamentals of using the legs, keeping the ball high and improving the arc will increase a player's skills, particularly using the shooting aid 10 and method of this invention.

Adjustable hoop 16, as mentioned, is flexible such that it blocks or interferes with a shot it does not reject the ball forcibly, which may injure a player during a teaching session.

In other sports such as baseball, the same principle and method applies, the "halo" being adjusted to demonstrate the optimum arc of a projectile in a specific sport.

What is claimed:

1. A trajectory training device for demonstrating the correct arc for a player's ball when shooting a basket, comprising:

a hoop of a size to allow a player to shoot a ball through it without interference;

means for supporting said hoop at a height over a player's head;

a base means for supporting said support means in a vertical position, and where said base means supports said support means such that said hoop extends beyond said base means to allow a player to stand under said hoop without being interfered with by said base means;

said base means having a T-shape wherein a pair of elements form a cross member and a longer member connected to said cross member between said pair of elements, said longer member having a free end to which said support means is connected;

said hoop is adjustable on said support means to raise or lower the height of said hoop;

a "T" coupling having opposed ends; and said hoop comprises a series of flexible, plastic members removably attached together and formed into a circular hoop having its free ends inserted into the opposed ends of said "T" coupling and removably attached thereto to maintain the circular hoop shape.

* * * * *